United States Patent [19]

Koehnle

[11] 3,968,875

[45] July 13, 1976

[54] RACKET PRESS, COVER AND BALL HOLDER

[76] Inventor: Ronald L. Koehnle, 1122 Archer Road, Bedford, Ohio 44146

[22] Filed: Feb. 26, 1975

[21] Appl. No.: 553,238

[52] U.S. Cl. ..... 206/315 B; 273/74; 206/72; 211/14

[51] Int. Cl.[2] ..... A65D 55/00; B65D 85/00; A63B 49/16; A63B 49/18

[58] Field of Search ..... 273/74; 206/315, 72; 220/283, 333–343; 211/14; 224/5 D; D34/5 ST

[56] References Cited

UNITED STATES PATENTS

| | | | |
|---|---|---|---|
| 2,134,411 | 10/1938 | Marx | 206/315 |
| 2,548,330 | 4/1951 | Wiseman | 224/5 D |
| 2,926,912 | 3/1960 | Gould | 273/74 |

FOREIGN PATENTS OR APPLICATIONS

| | | | |
|---|---|---|---|
| 245,607 | 1/1926 | United Kingdom | 273/74 |

*Primary Examiner*—William Price
*Assistant Examiner*—Douglas B. Farrow
*Attorney, Agent, or Firm*—William N. Hogg

[57] ABSTRACT

A combined racket press, cover, and ball holder is disclosed. The device is a pair of mating members formed of a rigid material disposed to cover the head of the racket. Raised channel members arranged in a trapezoidal configuration are provided to bear against the frame and operate as a press when the members are drawn together by nuts and bolts. A raised flange is provided which forms three annular rims with pockets therein shaped to frictionally engage three tennis balls and hold them.

6 Claims, 10 Drawing Figures

RACKET PRESS, COVER AND BALL HOLDER

BACKGROUND OF THE INVENTION

This invention relates generally to a tennis ball carrier and racket press and cover, and more particularly is directed to an improved racket press and cover which has formed as a part thereof a tennis ball carrier or holder.

As is well known in the art, tennis balls are normally purchased in sealed vacuum cans and opened for play. It is not possible to reseal the balls in these vacuum cans and also resecuring the lid thereon is not always entirely satisfactory. Further, a can necessitates the carrying of a separate piece of equipment apart from the racket, the press, and the cover, to the courts.

Also, in the past it has been common practice to form racket covers of soft materials and these may be used either in conjunction with or separately from a racket press. While these covers do protect the racket from moisture in the form of rain and dust and other foreign substances, these soft covers do not protect the strings against damage, especially from objects inadvertantly banged against them.

SUMMARY OF THE PRESENT INVENTION

According to the present invention, a combination racket press, cover and ball holder is provided, all made of a relatively rigid material. The device is formed of two mating halves which when mated together form a cover for the racket which will not only protect the racket from foreign substances such as moisture, rain and dust, but will also resist impact blows on it without allowing the strings to be damaged. The device also includes a racket press formed integral therewith which will allow the racket to be pressed in a relatively conventional manner to prevent warping. Further, one of the members is formed with a ball carrier thereon which will store preferably three tennis balls so that in a single device a racket cover, racket press and ball holder is provided, thereby providing all of the essential elements when combined with racket for the playing of the game and protecting of the racket.

DESCRIPTION OF THE PREFERRED EMBODIMENT

Figure 1:
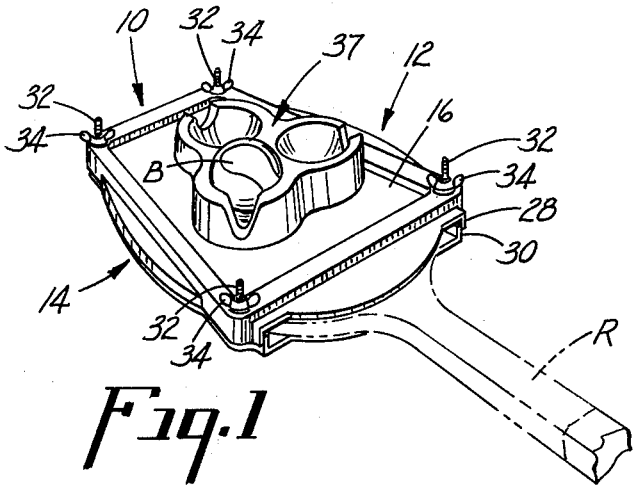
FIG. 1 is a perspective view showing a combined racket press, cover and ball holder according to this invention as it is placed on a tennis racket shown in phantom.
Figure 2:
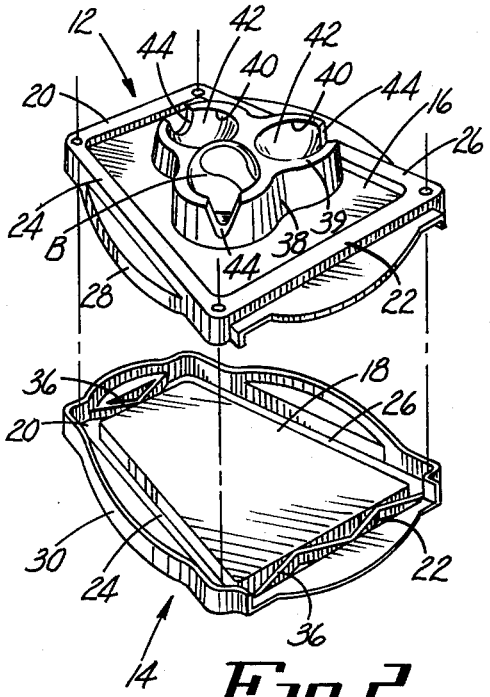
FIG. 2 is an exploded view of the mating members forming the device.

Referring now to the drawing, a racket press, cover and ball holder according to this invention is shown and designated generally by the reference character 10. In FIG. 1 the device is shown as it is normally used in place on a racket R.

The device 10 is formed of two separate members 12 and 14, each of which is formed of a relatively rigid material, preferably a rigid plastic, although other materials such as aluminum could be utilized. Members 12 and 14 are formed with cover portions 16 and 18 respectively which are adapted to overlie the opposite sides of the head of the racket R when the device is in place. The members 12 and 14 are also each provided with a pair of end ribs 20 and 22 and side ribs 24 and 26 which form an equilateral trapezoidal configuration generally in a shape of a conventional racket press. These ribs 20, 22, 24 and 26 are formed integrally with the cover portions 16 and 18 and are so located that they will engage the frame portion of the head of the racket. Conventional screws 32, nuts 34 and compression springs 35 are provided at the four corners where the ribs 20, 22, 24 and 26 come together, and extend through openings (unnumbered) formed therein, so that when the members are mated together over the racket as shown in FIG. 1, the wing nuts can be attached and tightened down with the ribs acting against the frame of the racket.

The ribs 20, 22, 24 and 26 are all formed in the shape of a generally rectangular channel portion extending beyond and upward from the cover portions 16 and 18 of their respective members. These raised rectangular channel configurations provide a rather strong configuration reinforcing the cover member and providing for the necessary rigidity of the ribs 20, 22, 24 and 26 to act as a press bearing against the racket frame. However, in some cases it may be desirable, depending upon the exact configuration of the channel, to add stiffening webs which are shown in the ribs 20 and 22 and designated with the reference character 36. Depending upon the exact configuration and the material of which the rackets are formed, these stiffening webs add to or improve the resistance to flexure of the ribs under the action of the nut and screws tightening against the racket frame.

Figure 5:
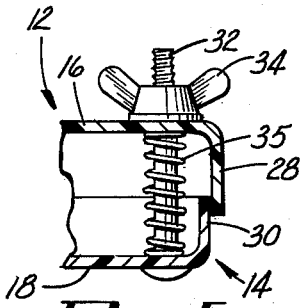
FIG. 5 is a detailed sectional view of one corner of the device showing a screw and nut securing other members.
Figure 3:
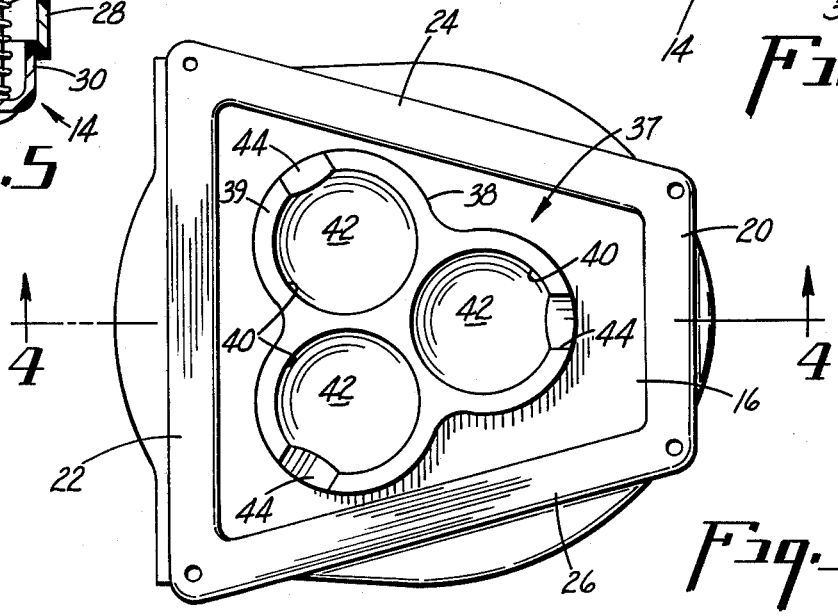
FIG. 3 is a plan view of the device.

The members 12 and 14 are also provided with depending side ribs 28 and 30 which are arranged to lie in overlapping relationship or configuration as shown especially in FIG. 5 when the members are mated and in place on a racket head so as to provide an enclosure not only on the faces of the racket but also on the edges.

The member 12 is also provided on the outer face thereof with ball holding means designated generally 37 formed integral therewith of the same material such as preferably plastic or the metal of which it is formed. It is rigid and self-sustaining in configuration. In the preferred embodiment the ball holding means is configured to hold three tennis balls, this being the conventional number that is found in a can of balls and therefore provision is made for three tennis balls. The ball holding means 37 includes a raised flange 38 which extends upward from the ball surface of the cover portion 16 of the member 12 and terminates at the top thereof in a flat portion 39, the flat portion 39 defining three rims 40, each of which is adapted to receive a tennis ball B. Extending inwardly from the rims 40 are three hemispherical portions 42 which together with the rims 40 define a pocket for the tennis balls. The raised flange 38 is provided with three cutouts 44, each of which extends therethrough to provide access to the interior of one of the ball pockets for a purpose which will appear presently.

Figure 4:
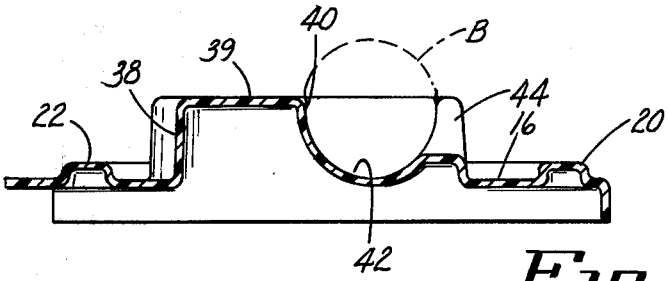
FIG. 4 is a sectional view taken substantially along the plane designated by the line 4—4 of FIG. 3.
Figure 6:
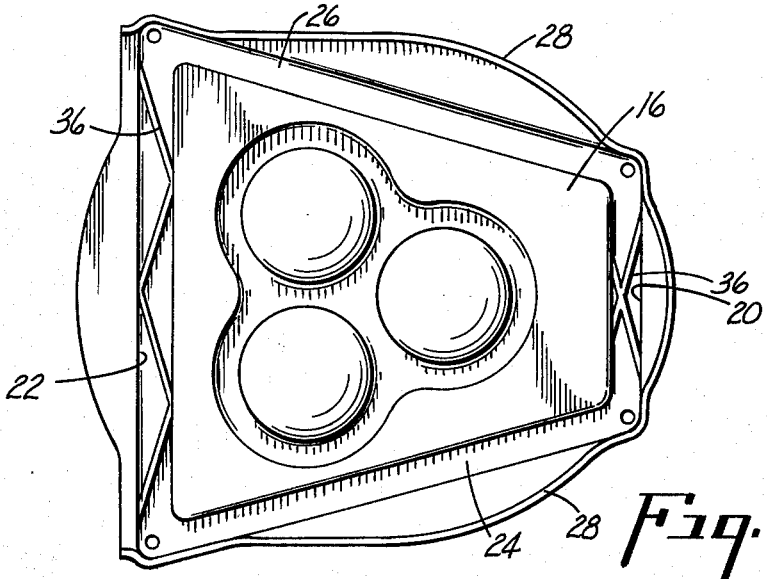
FIG. 6 is a bottom plan view of the member shown in FIG. 3.
Figure 7:
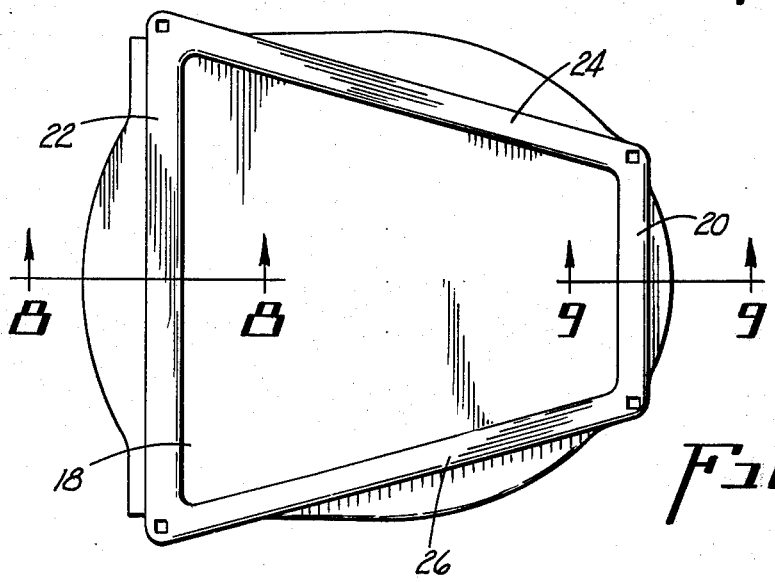
FIG. 7 is a top plan view of the other member or portion of the device.
Figure 10:
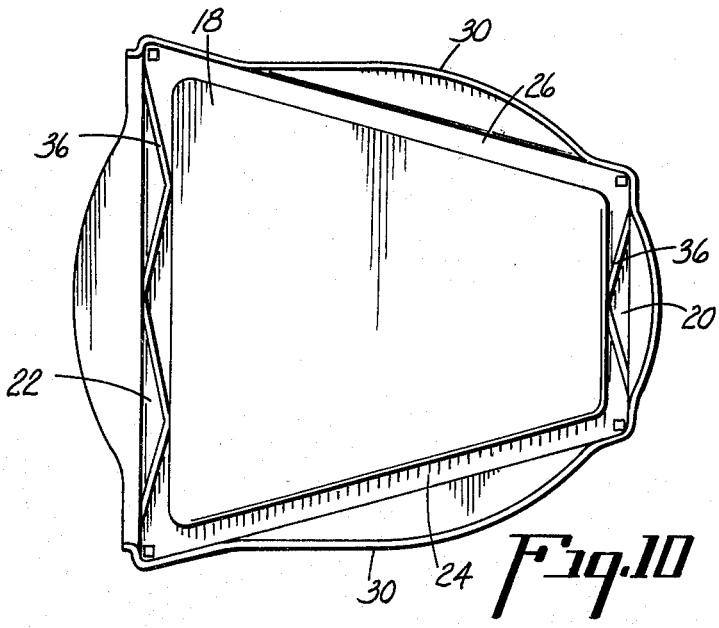
FIG. 10 is a bottom plan view of the member shown in FIG. 7.
Figure 8:
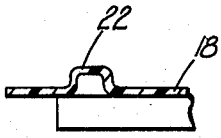
FIG. 8 is a sectional view taken substantially along the plane designated by the line 8—8 of FIG. 7.
Figure 9:
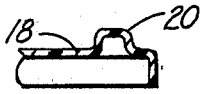
FIG. 9 is a sectional view taken substantially along the plane designated by the line 9—9 of FIG. 7.

The diameter of each of the rims 40 is slightly less than that of a tennis ball, and the height of the rim 40 above the bottom of the hemispherical portion 42 is at least equal to the radius of the tennis ball so that when the tennis ball B is placed in the pocket as shown in FIG. 4 it will be slightly squeezed inwardly, and due to this inward squeezing compression action will be retained in the pocket. The diameter of a new unused tennis ball is approximately 2.500 inches. Thus it is preferred that the diameter of the rim portions 40 each be less than this 2.500 inch diameter of a new tennis ball but preferably it should not be any less than about 2.400 inches so that excessive compression is not required to insert the ball and maintain the ball under force. However, it has been found that the optimum diameter of the rim is about 2.45 inches. This allows for the snug reception of tennis balls which may vary slightly in diameter and also allows for differences in manufacturing tolerances and also for any change in diameter of the ball due to wear by virtue of the ball being utilized.

From the foregoing it can be seen that a combination press, cover and ball holder is provided wherein the press is strong enough to perform the conventional press function, the cover is made of a rigid material which will prevent damage due to impact blows, and the ball holder is formed of a relatively rigid upstanding self supporting material having a fixed precise dimension to start with. The ball holder can be utilized simply, and only one hand need be employed to insert and remove each tennis ball. Further, the cut outs 44 allow for one to slip a finger in to get a good purchase on the tennis ball and flip it out thus making removal of the ball easier. Hence a single device performing three separate functions is provided.

What is claimed is:

1. A combination racket press, cover, and ball holder comprising, a pair of mating members formed of a relatively rigid non-deformable material, said members each having a racket covering portion and a trapezoidal portion formed integrally therewith, said trapezoidal portion being formed of ribs raised from the cover, said racket covering portions being configured to substantially conform in shape with and to overlie and enclose the head of a racket and the trapezoidal portions being disposed to engage the frame of the racket head when the members are disposed together on the head of the racket, clamping means disposed to draw said members toward each other and cause said trapezoidal portions to exert force against the racket frame, ball holding means formed on the outside surface of one of said members, said ball holding means including an upstanding flange portion, a top surface defining an upper rim, said upper rim having inner edge means defining a tennis ball receiving opening, and an interior portion extending downwardly from said inner edge defining a ball receiving pocket.

2. The invention as defined in claim 1 wherein said flange has a cut out portion to allow access to the interior thereof.

3. The invention as defined in claim 2 wherein the cut out portion is in the form of a slot and extends from the top circular opening thereof.

4. The invention as defined in claim 1 wherein the ball holding means includes means for holding three balls.

5. The invention as defined in claim 1 wherein the diameter of the flange at the opening thereof is between about 2.400 inches and 2.500 inches.

6. The invention as defined in claim 1 wherein the diameter of the flange at the opening is about 2.450 inches.

* * * * *